United States Patent [19]

von Rybinski et al.

[11] Patent Number: 4,839,066

[45] Date of Patent: Jun. 13, 1989

[54] FABRIC-SOFTENING DETERGENT

[75] Inventors: Wolfgang von Rybinski, Duesseldorf; Horst Upadek, Ratingen; Winfried Wichelhaus, Mettmann, all of Fed. Rep. of Germany

[73] Assignee: Henkel Kommanditgesellschaft auf Aktien, Duesseldorf, Fed. Rep. of Germany

[21] Appl. No.: 146,991

[22] Filed: Jan. 22, 1988

[30] Foreign Application Priority Data

Jan. 24, 1987 [DE] Fed. Rep. of Germany ..... 3702067

[51] Int. Cl.[4] ..... D06M 13/26

[52] U.S. Cl. ..... 252/8.75; 252/548; 252/544; 252/529; 252/525; 252/174.25; 252/140; 252/8.6; 8/137; 423/328

[58] Field of Search ..... 252/8.75, 8.6, 8.8, 252/89 R, 135, 140, 155, 174.25; 8/137

[56] References Cited

U.S. PATENT DOCUMENTS

| | | | |
|---|---|---|---|
| 3,966,629 | 6/1976 | Dumbrell | 252/140 |
| 4,062,647 | 12/1977 | Storm et al. | 8/137 |
| 4,737,306 | 4/1988 | Wichelhaus et al. | 252/95 |

FOREIGN PATENT DOCUMENTS 0109717.8 6/1986 European Pat. Off. .

*Primary Examiner*—A. Lionel Clingman
*Assistant Examiner*—John F. McNally
*Attorney, Agent, or Firm*—Ernest G. Szoke; Wayne C. Jaeschke; Real J. Grandmaison

[57] ABSTRACT

Detergent composition containing conventional surfactants and builders, a fabric-softening silicate of the smectite type, and a synthetic incrustation-inhibiting layer silicate having a smectite-like crystal phase and reduced swelling power in water by comparison with natural smectite. The composition provides a significant increase in the softening effect of the detergent on a fabric washed therewith.

20 Claims, No Drawings

FABRIC-SOFTENING DETERGENT

BACKGROUND OF THE INVENTION

1. Field of the Invention

This invention relates to a fabric-softening detergent composition containing surfactant, builders and a fabric-softening layer silicate of the smectite type with an incrustation-inhibiting synthetic layer silicate.

In many cases, a soft, full feel is to be imparted to washed fabrics. One way of improving the wearing comfort of fabrics is to treat the washed fabrics with fabric-softening agents in the final rinse after washing. For this purpose, cationic compounds are generally allowed to act on the washed fabrics so that the fabrics, having taken up the cationic compounds, feel soft after drying. Another way of obtaining this effect is to allow the fabric-softening agents to act on the fabrics during the subsequent drying of the washing in an automatic dryer. One feature common to both methods of softening fabrics is that the softening agents have to be allowed to act on the fabrics separately from the detergent after the actual washing process. This involves additional effort which could be avoided if the softening agents could be allowed to act on the fabrics at the same time as the detergent, i.e., during the washing process. However, high-performance detergents generally contain anionic surfactants which are incompatible with the cationic fabric softeners because they react with them to form compounds which are substantially ineffective in regard to their detergency and their softening effect.

2. Discussion of Related Art

Attempts have been made to overcome the aforementioned problem by employing nonionic fabric softeners. However, nonionic compounds have the disadvantage compared with cationic fabric softeners that, unlike the cationic compounds, they are not substantially or completely adsorbed by the textile fibers. Accordingly, it has been proposed in U.S. Pat. Nos. 3,966,629 and 4,062,647 to use clay-like minerals of the smectite type which are compatible with anionic surfactants as fabric-softening agents. The clay-like materials mentioned are adsorbed onto the fibers of the fabrics and, by virtue of their layer-like crystal structure, exert a softening effect when used during the actual fabric washing process. Thus, layer silicates of the type in question have been used for some time in fabric-softening detergents. One disadvantage of these softening layer silicates is that they accumulate on the fabrics and, hence, can contribute towards additional incrustation of the washed fabrics under certain conditions.

DESCRIPTION OF THE INVENTION

Other than in the operating examples, or where otherwise indicated, all numbers expressing quantities of ingredients or reaction conditions used herein are to be understood as modified in all instances by the term "about".

Accordingly, an object of the present invention is to provide a fabric-softening detergent composition containing conventional surfactants and builders, and also a fabric-softening layer silicate of the smectite type having a reduced tendency towards incrustation. It has now surprisingly been found that detergent compositions of the type in question are obtained if they additionally contain an incrustation-inhibiting synthetic layer silicate having a smectite-like crystal structure and corresponding to the following oxide summation formula $$MgO \cdot a\ M_2O \cdot b\ Al_2O_3 \cdot c\ SiO_2 \cdot n\ H_2O \qquad (I)$$

wherein M represents sodium, optionally together with lithium, with the proviso that the molar ratio of Na to Li is at least 2, and in which a is equal to 0.05 to 0.4, b is equal to 0 to 0.3, c is equal to 1.2 to 2.0, and n is equal to 0.3 to 3.0, n representing the water bound in the crystal structure, the fabric-softening layer silicate being present in such quantity that significant softening of the fabrics washed therewith is provided and the incrustation-inhibiting layer silicate being present in such quantity that a significant reduction in incrustation is provided. The incrustation-inhibiting synthetic layer silicate corresponding to oxide summation formula (I) has been proposed in earlier European patent application no. 86/109717.8 as a constituent of detergents and cleaning preparations. These layer silicates have a limited swelling power and themselves make little, if any, contribution as a fabric softener. Accordingly, all the more surprising is the finding that, for the same detergency, detergents having the composition according to this invention have a better softening effect than detergents which only contain fabric-softening layer silicate of the smectite type in the same quantity. In order to obtain the same softening effect as with the detergents according to this invention, it would be necessary in conventional detergents to significantly increase the amount of fabric-softening layer silicates of the smectite type. The increase in the softening effect of the detergents having the composition according to this invention by the addition thereto of synthetic layer silicate is surprising because the synthetic layer silicate itself has virtually no softening effect.

The incrustation-inhibiting synthetic layer silicate to be used together with the fabric-softening layer silicate of the smectite type in accordance with this invention comprises the layer silicates having a smectite-like crystal structure, but in comparative terms, having a distinctly reduced swelling power in water as described in earlier-filed European patent application No. 86/109717.8. These layer silicates are synthetic, finely divided water-insoluble layer silicates which have a smectite-like crystal structure, but have increased contents of bound alkali metal and silicate and a distinctly reduced swelling power in aqueous suspension by comparison with pure layer silicates of this type and which correspond to the following oxide summation formula $$MgO \cdot a\ M_2O \cdot b\ Al_2O_3 \cdot c\ SiO_2 \cdot n\ H_2O$$

wherein M represents sodium or a mixture of sodium and lithium, with the proviso that the molar ratio of sodium to lithium is at least 2, and in which the parameters a, b, c and n each represent a number within the following ranges:

a=0.05 to 0.4,
b=0 to 0.3,
c=1.2 to 2.0, and
n=0.3 to 3.0.

In this oxide summation formula, the water content n $H_2O$ represents the water bound in the crystal phase. These very finely-divided clay minerals may be regarded as layer silicates having structural features of mica-like layer silicates, albeit with a dislocation in regard to the linkage of adjacent layers. A structural formula of the type usually expressed in idealized form for clay minerals can only be drawn up under additional hypotheses for the layer silicates according to the invention. However, the chemical composition of the new compounds shows more $Na_2O$ and $SiO_2$ than the associated saponite and hectorite smectites. It may be assumed that, in addition to the layer arrangement typical of mica-like compounds of this type, these layer silicates contain units of incorporated sodium silicates. From the view point of structure and synthesis, the cystallization of the layer silicates may presumably be interpreted as a mixed crystal formation in which sodium silicate is incorporated in smectite. The X-ray diffractograms show that this incorporation is not regular, but instead leads to dislocations in the crystallites. Accordingly, crystallographic characterization by lattice constants which describe an elementary cell is not possible. On the basis of the chemical composition selected, synthetic smectites as defined above include saponite- and hectorite-like phases. The mixed crystal system should therefore be described by the following structural formula $$[Na_{x+y}(Mg_{3-x}Li_x)(Si_{4-y}Al_y)O_{10}(OH)_2]\cdot m[Na_2Si_zO_{2z+1}]\cdot n\ H_2O$$

the first part of the formula characterizing the smectite, and the second part the sodium polysilicate. Both components form one phase in which the smectite determines the structure.

The variables may assume the following numerical values:

$x=0$ to 0.3, preferably 0 to 0.1,
$y=0$ to 0.5, preferably 0 to 0.4,
$x+y=0.1$ to 0.5, preferably 0.2 to 0.4,
$z=1$ to 22, preferably 1 to 14,
$m=0.1$ to 0.5, preferably 0.1 to 0.3, and
$n=0$ to 8, preferably 2 to 6.

The composition of the synthetic layer silicates according to this invention which differs distinctly from the pure smectites and having the associated dislocation in the crystal structure leads to changes in a number of properties typical of layer silicates per se, particularly in regard to their swellability and hence their gel-forming properties and also in their exchange capacity.

Conventional surfactants in the context of this invention may contain at least one hydrophobic organic radical and a watersolubilizing anionic, zwitter-ionic or nonionic group in the molecule. The hydrophobic radical is generally an aliphatic hydrocarbon radical containing from 8 to 26, preferably from 10 to 22, and more preferably from 12 to 18 carbon atoms, or an alkyl aromatic radical containing from 6 to 18, and preferably from 8 to 16, aliphatic carbon atoms.

Suitable anionic surfactants include, for example, soaps of natural or synthetic, preferably saturated, fatty acids or even of resinic or naphthenic acids. Suitable synthetic anionic surfactants include those of the sulfonate, sulfate and synthetic carboxylate type.

Suitable surfactants of the sulfonate type include alkyl benzenesulfonates ($C_9$ to $C_{15}$ alkyl, olefin sulfonates, i.e. mixtures of alkene and hydroxyalkane sulfonates and also disulfonates of the type obtained, for example, from $C_{12}$–$C_{18}$ monoolefins containing a terminal or internal double bond by sulfonation with gaseous sulfur trioxide and subsequent alkaline or acidic hydrolysis of the sulfonation products. Also suitable are the alkane sulfonates obtained from $C_{12}$–$C_{18}$ alkanes by sulfochlorination or sulfoxidation and subsequent hydrolysis or neutralization or by bisulfite addition to olefins, and esters of α-sulfofatty acids, for example α-sulfonated methyl or ethyl esters of hydrogenated coconut oil, palm kernel oil or tallow fatty acids.

Suitable surfactants of the sulfate type include the sulfuric acid monoesters of primary alcohols of natural and synthetic origin, i.e. of fatty alcohols such as, for example, coconut oil fatty alcohols, tallow fatty alcohols, oleyl alcohol, lauryl, myristyl, palmityl or stearyl alcohol, or the $C_{10}$–$C_{20}$ oxoalcohols and secondary alcohols of the same chain length. Sulfuric acid monoesters of aliphatic primary alcohols ethoxylated with from 1 to 6 moles of ethylene oxide, ethoxylatd secondary alcohols and alkylphenols are also suitable. Sulfated fatty acid alcohol amides and sulfated fatty acid monoglycerides are also suitable.

Other suitable anionic surfactants include the fatty acid esters and amides of hydroxycarboxylic or aminocarboxylic acids and sulfonic acids, such as for example fatty acid sarcosides, glycolates, lactates, taurides or isethionates.

The anionic surfactants may be present in the form of their sodium, potassium and ammonium salts and also as soluble salts of organic bases, such as mono-, di- or tri-ethanolamine.

Suitable nonionic surfactants include adducts from 1 to 40, and preferably from 2 to 20, moles of ethylene oxide with 1 mole of a compound containing 10 to 20 carbon atoms selected from the group consisting or an alcohol, alkylphenol, fatty acid, fatty amine, fatty acid amide or alkane sulfonamide. Of particular importance are the adducts of from 8 to 80 moles ethylene oxide with a primary alcohol, such as for example coconut oil or tallow fatty alcohols, with oleyl alcohol, with oxoalcohols or with secondary alcohols containing from 8 to 18 and preferably from 12 to 18 carbon atoms and with mono- or dialkylphenols containing from 6 to 14 carbon atoms in the alkyl radicals. In addition to these water-soluble nonionics, however, water-insoluble or substantially water-insoluble polyglycol ethers containing from 2 to 7 ethylene glycol ether groups in the molecule are also useful, particularly if they are used together with water-soluble nonionic or anionic surfactants.

Other suitable nonionic surfactants include the water-soluble adducts, containing from 20 to 250 ethylene glycol ether groups and from 10 to 100 propylene glycol ether groups, of ethylene oxide with polypropylene glycol, alkylenediamine polypropylene glycol and with alkyl polypropylene glycol containing from 1 to 10 carbon atoms in the alkyl chain, in which the polypropylene glycol chain functions as the hydrophobic component. It is also possible to use nonionic surfactants of the amine oxide or sulfoxide type, for example, the compounds N-cocosalkyl-N,N-dimethylamine oxide,N-hexadecyl-N,N-bis-(2,3-dihydroxypropyl)-amine oxide, and N-tallow alkyl-N,N- dihydroxy-ethylamine oxide.

The zwitter-ionic surfactants are preferably derivatives of aliphatic quaternary ammonium compounds, in which one of the aliphatic radicals consists of a $C_8$–$C_{18}$ radical, while another contains an anionic, water-solubilizing carboxy, sulfo or sulfonate group. Typical representatives of surface-active betaines such as these include, for example, the compounds 3-(N-hexadecyl-N,N-dimethylammonio)-propane sulfonate;3-(N-tallow alkyl-N,N-dimethylammonio)-2-hydroxypropane sulfonate; 3-(N-hexadecyl-N,N-bis-(2-hydroxyethyl)-ammonio)-2-hydroxypropyl sulfate; 3-(N-cocosalkyl-N,N-bis-(2,3-dihydroxypropyl)-ammonio)-propane sulfonate; N-tetradecyl-N,N-dimethylammonioacetate;

and N -hexadecyl-N,N-bis-(2,3-dihydroxypropyl)-ammonioacetate.

The foaming power of the surfactants may be increased or reduced by combining suitable surfactant types; and a foaming reduction may also be obtained by the addition of non-surfactant-like organic compounds. Reduced or suppressed foaming power, which is desirable where the detergents or cleaning preparations are used in machines, may often be obtained by combining surfactants of various types, for example sulfates and/or sulfonates with nonionic surfactants and/or soaps. In the case of soaps, foam inhibition increases with the degree of saturation and the number of carbon atoms in the fatty acid component. Accordingly, soaps of saturated $C_{20}$–$C_{24}$ fatty acids are particularly suitable as foam inhibitors.

The non-surfactant-like foam inhibitors are generally water-insoluble compounds mostly containing aliphatic $C_8$–$C_{22}$ hydrocarbon radicals. Suitable non-surfactant-like foam inhibitors include, for example, N-alkylamino-triazines, i.e. reaction products of 1 mole cyanuric chloride with 2 to 3 moles of a mono- or dialkylamine essentially containing from 8 to 18 carbon atoms in the alkyl radical. Other suitable non-surfactant-like foam inhibitors include propoxylated and/or butoxylated amino-triazines, for example the reaction products of 1 mole melamine with from 5 to 10 moles of propylene oxide and, in addition, from 10 to 50 moles of butylene oxide, and also aliphatic $C_{18}$–$C_{40}$ ketones such as, for example, stearone, fatty ketones of hardened train oil fatty acid or tallow fatty acid, paraffins and halogen paraffins melting below 100° C., and silicone oil emulsions based on polymeric organosilicon compounds.

Suitable builders include, typically, organic and inorganic salts, particularly alkali metal salts, showing a mildly acidic, neutral or alkaline reaction which are capable of precipitating or complexing calcium ions. Of the inorganic salts, the water-soluble alkali metal metaphosphates or alkali metal polyphosphates, particularly pentasodium triphosphate, are of particular importance along with alkali metal orthophosphates and alkali metal pyrophosphates. These phosphates may be completely or partly replaced by organic complexing agents for calcium ions, including compounds of the aminopolycarboxylic acid type, such as for example nitrilotriacetic acid (NTA), ethylenediamine tetraacetic acid (EDTA), diethylenetriamine penta-acetic acid and higher homologs. Suitable phosphorus-containing organic complexing agents include the water-soluble salts of alkane polyphosphonic acids, amino- and hydroxyalkane polyphosphonic acids and phosphonopolycarboxylic acids such as, for example, methane diphosphonic acid, dimethylaminomethane-1,1-diphosphonic acid, aminotrimethylene triphosphonic acid, 1-hydroxyethane-1,1-diphosphonic acid, 1-phosphonoethane-1,2-dicarboxylic acid, and 2-phosphonobutane-1,2,4-tricarboxylic acid.

Among the organic builders, nitrogen- and phosphorus-free polycarboxylic acids which form complex salts with calcium ions, including polymers containing carboxyl groups, are of particular significance. Suitable organic builders of this type include, for example, citric acid, tartaric acid, benzenehexacarboxylic acid and tetrahydrofuran tetracarboxylic acid. Also suitable are polycarboxylic acids containing ether groups, such as 2,2'-oxydisuccinic acid and polyfunctional alcohols or hydroxy-carboxylic acids completely or partly etherified with glycolic acid, for example bis-carboxymethyl ethylene glycol, carboxymethylsuccinic acid, carboxymethyl tartronic acid and carboxymethylated or oxidized polysaccharides. Polymeric carboxylic acids having a molecular weight of from 350 to 1,500,000 in the form of water-soluble salts are also suitable. Particularly preferred polymeric polycarboxylates have a molecular weight of from 500 to 175,000 and more especially in the range from 10,000 to 100,000. These compounds include, for example, polyacrylic acid, poly-α-hydroxyacrylic acid, polymaleic acid and also copolymers of the corresponding monomeric carboxylic acids with one another or with ethylenically unsaturated compounds, such as vinyl methyl ether. Water-soluble salts of polyglyoxylic acid are also suitable. Suitable water-insoluble inorganic builders include the finely-divided, synthetic sodium aluminosilicates of the zeolite A type containing bound water as described in German patent application 24 12 837 as a phosphate substitute for detergents and cleaning preparations.

The cation-exchanging sodium aluminosilicates are used in their usual hydrated, finely crystalline form, i.e. they contain virtually no particles larger than 30 microns and preferably consist of at least 80% of particles smaller than 10 microns in size. Their calcium binding power as determined in accordance with afore-mentioned German patent application 24 12 837 is in the range from 100 to 200 mg CaO/g. Zeolite NaA is particularly suitable as are zeolite NaX and mixtures of NaA and NaX.

Suitable inorganic, non-complexing salts include the alkali metal salts, also known as "washing alkalis", of bicarbonates, carbonates, borates, sulfates and silicates. Of the alkali metal silicates, sodium silicates in which the ratio $Na_2O$ to $SiO_2$ is from 1:1 to 1:3.5 are particularly preferred.

Other suitable builders which are generally used in liquid preparations by virtue of their hydrotropic properties include the salts of non-capillary-active $C_2$–$C_9$ sulfonic acids, carboxylic acids and sulfocarboxylic acids, for example the alkali metal salts of alkane, benzene, toluene, xylene or cumene sulfonic acids, sulfobenzoic acids, sulfophthalic acid, sulfoacetic acid, sulfosuccinic acid and the salts of acetic acid or lactic acid. Acetamide and urea are also suitable solubilizers.

Highly swellable, finely-divided layer silicates have been known for decades as a costituent of detergents. Both natural and crystalline smectites having a highly swellable layer structure have been proposed in various connections as a constituents of fabric detergents. Bentonite in particular has been frequently mentioned as a detergent or detergent additive. Corresponding synthetic or semi-synthetic, water-insoluble, finely divided layer silicates having a smectite structure and, in particular, corresponding hectorites, saponites and montmorillonites are now well-known commercial products for numerous fields of application. A crucial factor is always prevalent here by the high swellability which is attributable to the ability of the class of layer silicates in question here to incorporate water and/or organic cationic compounds in the crystal lattice structure, widening the layer intervals in the process. Swellable layer silicates and, in particular, montmorillonite, hectorite and saponite in the sodium form are deposited in thin layers on textile fibers and thus influence the softness and feel of the washed fabrics. Combining the washing and softening of fabrics in this way into a single process is, inter alia, the subject of the above-cited U.S. Pat. Nos. 3,966,629 and 4,062,647. The swellable smectites having softening properties which are described therein may also be used in the detergent compositions according to the present invention.

Detergent compositions having particularly valuable properties contain the synthetic smectite-like layer silicate corresponding to afore-mentioned formula I, and the fabric-softening smectite in a ratio by weight of from 4:1 to 1:6. Within this range, it is possible to produce detergent compositions having particularly balanced properties in regard to their washing effect and softening effect, i.e. it is possible to formulate detergents having both a good fabric softening effect and a minimal tendency towards incrustation of the fabrics. In a preferred embodiment, the two layer silicates of the detergent compositions according to this invention are present in intimate admixture. An intimate mixture such as this may be produced, for example, by forming a premix containing an incrustation-inhibiting layer silicate corresponding to formula I and a fabric-softening layer silicate of the smectite type, preferably in a weight ratio of from 4:1 to 1:6, and optionally, auxiliaries and additives. The auxiliaries and additives may be used to impart particular properties, such as for example a certain particle strength or high dispersibility in the wash solution, to the intimate mixture of the two layer silicates. Corresponding premixes may be prepared by known mixing and working-up techniques, such as for example granulation or spray-drying. Accordingly, a detergent premix containing the two layer silicates and a detergent containing such a premix are further subjects of the present invention. Detergent compositions according to the invention contain in particular from 2 to 12% by weight of incrustation-inhibiting layer silicate corresponding to formula I, and from 3 to 15% by weight of fabric-softening layer silicate of the smectite type. Within these ranges it is possible to produce detergent compositions having optimized properties.

The fabric detergent and softening preparations according to this invention may contain as a further component soil suspending agents which suspend the soil detached from the fibers in the solution and thus prevent soil redeposition. Suitable soil suspending agents include water-soluble, generally organic colloids, such as for example water-soluble salts of polymeric carboxylic acids, glue, gelatin, salts of ether carboxylic acids or ether sulfonic acids of starch or cellulose, and salts of acidic sulfuric acid esters of cellulose or starch. Water-soluble polyamides containing acidic groups are also suitable for this purpose. It is also possible to use soluble starch preparations and other starch products than those mentioned above, such as for example degraded starch, aldehyde starches etc. Polyvinylpyrrolidone may also be used. In many cases, an addition of polyvinylpyrrolidone suppresses the undesired transfer of dyes which have been detached from intensively dyed fabrics, to less intensively dyed or undyed fabrics.

Among the compounds releasing $H_2O_2$ in water which are used as bleaches, sodium perborate tetrahydrate ($NaBO_2 \cdot H_2O_2 \cdot 3H_2O$) and the monohydrate ($NaBO_2 \cdot H_2O_2$) are of particular importance. However, other borates which yield $H_2O_2$, for example perborax $Na_2B_4O_7 \cdot 4\ H_2O_2$, are also suitable. These compounds may be completely or partly replaced by other active oxygen carriers, more especially by peroxypyrophosphates, citrate perhydrates, urea/$H_2O_2$ or melamine/$H_2O_2$ compounds and by $H_2O_2$ - yielding peracidic salts, such as for example caroates ($KHSO_5$), perbensoates or peroxyphthalates.

Since the detergent compositions according to this invention are inter alia intended for washing at low washing temperatures, bleach components containing activators are preferably incorporated therein. Certain N-acyl and O-acyl compounds which form organic per-acids serve as activators for per compounds releasing $H_2O_2$ in water. Suitable compounds include, inter alia, N-diacylated and N,N'-tetra-acylated amines such as, for example N,N,N',N'-tetra-acetyl methylenediamine and ethylenediamine or tetra-acetyl glycoluril.

The detergent compositions may additionally contain optical brighteners, for example for cotton or polyamide fibers.

The detergent compositions according to this invention may be present both in particulate forms, i.e. as generally produced by spray-drying, spray-cooling or by granulation, and in liquid or pasty form. In the production of liquid or pasty forms, organic solvents, for example lower alcohols, ether alcohols or ketones containing 1 to 6 carbon atoms, are additionally used.

EXAMPLE I 616 g of magnesium sulfate heptahydrate were dissolved in 2 liters of deionized water and the resulting solution was reacted while being vigorously stirred with 755 g of a sodium silicate solution containing 27 g of $SiO_2$ and 8 g of $Na_2O$ per 100 g. A finely divided suspension was formed. A solution of 404 g of 50% sodium hydroxide, 1.5 liters deionized water and 20.2 g of hydrargillite containing 63% $Al_2O_3$ was added to this suspension with continued stirring.

The suspension was then heated for 20 minutes to 190° C. in a stirring autoclave and stirred at that temperature for 4 hours. After cooling to 100° C., the stirring autoclave was emptied and the layer silicate formed was filtered off from the mother liquor. The filter cake was washed with deionized water on the filter until no more sulfate could be detected in the washing water. The filter cake was then dried at about 100° C. in a recirculating air drying cabinet.

Analysis of the product according to this invention produced the following composition (in % by weight): MgO: 22.8%, $Na_2O$: 5.7%, $Al_2O_3$:3.2%, $SiO_2$: 46.8%, $H_2O$: 21.2%.

The X-ray diffractogram of the layer silicates shows broad reflexes with maxima at d (A): 13.4; 4.5; 2.57 and 1.535.

The dry product contained layer silicate and Na sulfate in a ratio by weight of 1:1.

EXAMPLE II

Test fabrics were washed 25 times with a detergent (product D) having the following composition:

8.0% by weight alkylbenzene sulfonate, Na salt;
1.5% by weight $C_{12/18}$ fatty alcohol +5 moles ethylene oxide, and
$C_{12/14}$ fatty alcohol+3 moles ethylene oxide in a weight ratio of 80:20;
0.5% by weight tallow alcohol+14 moles ethylene oxide;
2.4% by weight tallow alcohol+5 moles ethylene oxide;
0.8% by weight $C_{12/18}$ fatty acid, Na salt;
2.75% by weight waterglass 3.5:1 ($SiO_2$:$Na_2O$);
20.0% by weight Na perborate tetrahydrate;
1.5% by weight tetra-acetyl-ethylenediamine
25.0% by weight zeolite A;
0.8% by weight Na carbonate;

0.75% by weight CMC/MC;
0.3% by weight phosphonate;
4.0% by weight synthetic layer silicate of Example I;
8.0% by weight natural montmorillonite (DTE) ("Dis-This-Extra ®) and
remainder Na sulfate, water and the fabric ash subsequently determined.

Detergents having corresponding compositions which contain (A) no layer silicate, (B) only DTE, and (C) only synthetic layer silicate according to Example I were produced for comparison. The detergents were produced by spray drying and the layer silicate subsequently mixed in.

In addition, test fabrics were washed at 60° C. in an automatic domestic washing machine (West Germany Model Miele W 433) using the one-wash cycle in order to test the softening effect and primary detergency of the detergents. The softening effect was feel-tested by 5 experienced examiners and the washing effect by measurement of remission.

The product judged to be best in regard to detergency, softening effect and ash formation was product D according to this invention, while the product judged to be worst in every respect was product A containing no layer silicate.

Results comparable to those obtained with product D were obtained with detergent compositions which contained both natural smectites and synthetic layer silicates in other quantitative ratios and in other absolute quantities.

We claim:

1. A fabric-softening detergent composition comprising a surfactant, a builder, a fabric-softening layer silicate of the smectite type, and a fabric incrustation-inhibiting, water-insoluble, synthetic layer silicate having a smectite-like crystal structure corresponding to the oxide summation formula $$MgO \cdot a\ M_2O \cdot b\ Al_2O_3 \cdot c\ SiO_2 \cdot n\ H_2O \qquad (I)$$

wherein M represents sodium or sodium and lithium, with the proviso that the molar ratio of Na to Li is at least 2, and wherein a is equal to about 0.05 to about 0.4, b is equal to 0 to about 0.3, c is equal to about 1.2 to about 2.0, and n is equal to about 0.3 to about 3.0, wherein n represents the water bound in the crystal structure, said fabric-softening layer silicate being present in an amount sufficient to soften a fabric washed with said detergent composition, and said fabric incrustation-inhibiting layer silicate being present in an amount sufficient to provide a reduction of incrustation on said fabric, said fabric incrustation-inhibiting layer silicate being further characterized as having a limited swelling power in water and contributing substantially no fabric-softening effect.

2. A detergent composition as in claim 1 wherein said fabric incrustation-inhibiting synthetic layer silicate and said fabric-softening layer silicate are present in a weight ratio of from about 4:1 to about 1:6.

3. A detergent composition as in claim 1 wherein said fabric incrustation-inhibiting synthetic layer silicate and said fabric-softening layer silicate are present in the form of an intimate mixture with each other.

4. A detergent composition as in claim 3 wherein said intimate mixture is produced by forming a premix of said fabric incrustation-inhibiting synthetic layer silicate and said fabric-softening layer silicate.

5. A detergent composition as in claim 1 containing from about 2 to about 12% by weight of said fabric incrustation-inhibiting synthetic layer silicate, and from about 3 to about 15% by weight of said fabric-softening layer silicate, based on the weight of said detergent composition.

6. A detergent composition as in claim 1 wherein said fabric incrustation-inhibiting synthetic layer silicate having a smectite-like crystal structure corresponds to the oxide summation formula $$[Na_{x+y}(Mg_{3-x}Li_x)(Si_{4-y}Al_y)O_{10}(OH)_2] \cdot m[Na_2 \cdot Si_zO_{2z+1}] \cdot n\ H_2O$$

wherein x is equal to 0 to about 0.1, y is equal to 0 to about 0.4, x+y is equal to about 0.2 to about 0.4, z is equal to about 1 to about 14, m is equal to about 0.1 to about 0.3, and n is equal to about 2 to about 6.

7. A detergent composition as in claim 1 wherein said surfactant is selected from the group consisting of an anionic surfactant, a zwitter-ionic surfactant, and a nonionic surfactant.

8. A detergent composition as in claim 7 wherein said anionic surfactant is a sulfonate, sulfate, or carboxylate.

9. A detergent composition as in claim 7 wherein said nonionic surfactant is an adduct of from about 1 to about 40 moles of ethylene oxide with 1 mole of a compound containing about 10 to about 20 carbon atoms selected from an alcohol, alkylphenol, fatty acid, fatty amine, fatty acid amide, and alkane sulfonamide.

10. A detergent composition as in claim 1 wherein said builder is selected from an organic and an inorganic salt.

11. A premix for a detergent composition comprising a mixture of a fabric incrustation-inhibiting, water-insoluble, synthetic layer silicate and a fabric softening layer silicate, said fabric incrustation-inhibiting synthetic layer silicate having a smectite-like crystal structure corresponding to the oxide summation formula $$MgO \cdot a\ M_2O \cdot b\ Al_2O_3 \cdot c\ SiO_2 \cdot n\ H_2O \qquad (I)$$

wherein M represents sodium or sodium and lithium, with the proviso that the molar ratio of Na to Li is at least 2, and wherein a is equal to about 0.05 to about 0.4, b is equal to 0 to about 0.3, c is equal to about 1.2 to about 2.0, and n is equal to about 0.3 to about 3.0, wherein n represents the water bound in the crystal structure, said fabric incrustation-inhibiting layer silicate being further characterized as having a limited swelling power in water and contributing substantially no fabric-softening effect.

12. A premix as in claim 11 wherein said fabric incrustation-inhibiting synthetic layer silicate and said fabric-softening layer silicate are present in a weight ratio of from about 4:1 to about 1:6.

13. the process of washing and imparting a soft feel to a fabric comprising contacting said fabric with a wash liquor containing a detergent composition comprising a surfactant, a builder, a fabric-softening layer silicate of the smectite type, and a fabric incrustation-inhibiting, water-insoluble, synthetic layer silicate having a smectite-like crystal structure corresponding to the oxide summation formula $$MgO \cdot a\ M_2O \cdot b\ Al_2O_3 \cdot c\ SiO_2 \cdot n\ H_2O \qquad (I)$$

wherein M represents sodium or sodium and lithium, with the proviso that the molar ratio of Na to Li is at least 2, and wherein a is equal to about 0.05 to about 0.4, b is equal to 0 to about 0.3, c is equal to about 1.2 to about 2.0, and n is equal to about 0.3 to about 3.0, wherein n represents the water bound in the crystal structure, said fabric-softening layer silicate being present in an amount sufficient to soften a fabric washed with said detergent composition, and said fabric incrustation-inhibiting layer silicate being present in an amount sufficient to provide a reduction of incrustation on said fabric, said fabric incrustation-inhibiting layer silicate being further characterized as having a limited swelling power in water and contributing substantially no fabric-softening effect.

14. The process as in claim 13 wherein said fabric incrustation-inhibiting synthetic layer silicate and said fabric-softening layer silicate are present in a weight ratio of from about 4:1 to about 1:6.

15. The process as in claim 13 wherein said detergent composition contains from about 2 to about 12% by weight of said fabric incrustation-inhibiting synthetic layer silicate, and from about 3 to about 15% by weight of said fabric-softening layer silicate, based on the weight of said detergent composition.

16. The process as in claim 13 wherein said fabric incrustation-inhibiting synthetic layer silicate having a smectite-like crystal structure corresponds to the oxide summation formula $$[Na_{x+y}(Mg_{3-x}Li_x)(Si_{4-y}Al_y)O_{10}(OH)_2]\cdot m[Na_2Si_zO_{2z+1}]\cdot n\ H_2O$$

wherein x is equal to 0 to about 0.1, y is equal to 0 to about 0.4, x +y is equal to about 0.2 to about 0.4, z is equal to about 1 to about 14, m is equal to about 0.1 to about 0.3, and n is equal to about 2 to about 6.

17. The process as in claim 13 wherein said surfactant is selected from the group consisting of an anionic surfactant, a zwitter-ionic surfactant, and a nonionic surfactant.

18. The process as in claim 17 wherein said anionic surfactant is a sulfonate, sulfate, or carboxylate.

19. The process as in claim 17 wherein said nonionic surfactant is an adduct of from about 1 to about 40 moles of ethylene oxide with 1 mole of a compound containing about 10 to about 20 carbon atoms selected from an alcohol, alkylphenol, fatty acid, fatty amine, fatty acid amide, and alkane sulfonamide.

20. The process as in claim 13 wherein said builder is selected from an organic and an inorganic salt.

* * * * *